US011274620B2

(12) United States Patent
Yamada et al.

(10) Patent No.: US 11,274,620 B2
(45) Date of Patent: Mar. 15, 2022

(54) ENGINE GENERATOR

(71) Applicant: HONDA MOTOR CO., LTD., Tokyo (JP)

(72) Inventors: Makoto Yamada, Wako (JP); Kunihiro Kitsu, Wako (JP); Daiki Kamiyama, Wako (JP); Kazuya Miwa, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 94 days.

(21) Appl. No.: 16/747,788

(22) Filed: Jan. 21, 2020

(65) Prior Publication Data

US 2020/0291882 A1 Sep. 17, 2020

(30) Foreign Application Priority Data

Mar. 11, 2019 (JP) ..... JP2019-044164

(51) Int. Cl.
*F02D 41/14* (2006.01)
*F02B 63/04* (2006.01)

(52) U.S. Cl.
CPC ..... *F02D 41/1453* (2013.01); *F02B 63/048* (2013.01)

(58) Field of Classification Search
CPC ..... F02D 41/1453; F02D 17/04; F02D 29/06; F02B 63/048; F02B 63/042; F02B 77/08; F01P 5/02; F01P 2005/025
See application file for complete search history.

(56) References Cited

U.S. PATENT DOCUMENTS

| | | | | |
|---|---|---|---|---|
| 6,331,740 | B1 | 12/2001 | Morohoshi et al. | |
| 7,743,739 | B2 | 6/2010 | Kochi et al. | |
| 9,708,950 | B2 * | 7/2017 | Falkowski | F02D 41/005 |
| 2004/0007876 | A1 * | 1/2004 | Braun | F02D 29/06 290/1 A |
| 2004/0112119 | A1 * | 6/2004 | Watanabe | F02M 25/089 73/40 |
| 2008/0202447 | A1 | 8/2008 | Kochi et al. | |

(Continued)

FOREIGN PATENT DOCUMENTS

| | | |
|---|---|---|
| CN | 1823212 A | 8/2006 |
| JP | 3654567 B2 | 6/2005 |
| JP | 3701508 B2 | 9/2005 |

OTHER PUBLICATIONS

Chinese Office Action for Chines Patent Application No. 202010084462.1 dated Aug. 4, 2021 (partially translated).

*Primary Examiner* — Joseph J Dallo
(74) *Attorney, Agent, or Firm* — Thomas | Horstemeyer, LLP

(57) ABSTRACT

An engine generator, comprising an engine, a power generator configured to generate electric power based on motive power of the engine, a cooling fan configured to generate a cooling wind for cooling the engine, a control panel configured to accept an operation input by a user, a storage chamber configured to store a constituent part of the control panel, a sensor unit configured to detect a predetermined gas in the storage chamber, and a controller configured to stop the engine based on a detection result of the sensor unit, wherein the storage chamber stores the sensor unit and communicates with outer air such that a gas in the storage chamber can be suctioned by the cooling fan.

12 Claims, 5 Drawing Sheets

(56) References Cited

U.S. PATENT DOCUMENTS

| | | | | |
|---|---|---|---|---|
| 2009/0236860 | A1* | 9/2009 | Raasch | F02D 29/06 290/40 B |
| 2012/0310547 | A1* | 12/2012 | Cristoforo | G01N 33/0073 702/24 |
| 2017/0030307 | A1* | 2/2017 | Lucht | H04L 51/24 |
| 2018/0245526 | A1* | 8/2018 | Okada | F25B 13/00 |

* cited by examiner

ENGINE GENERATOR

CROSS-REFERENCE TO RELATED APPLICATION

This application claims priority to and the benefit of Japanese Patent Application No. 2019-044164 filed on Mar. 11, 2019, the entire disclosure of which is incorporated herein by reference.

BACKGROUND OF THE INVENTION

Field of the Invention

The present invention relates to an engine generator.

Description of the Related Art

There is available an engine and a power generator as a general-purpose power supply device used mainly outdoors. Such a power supply device is called an engine generator or the like (Japanese Patent Nos. 3654567 and 3701508). This engine generator can generate electric power by a power generator based on the motive power of the engine and supply the electric power to a predetermined electrical device. Since an exhaust gas is generated by driving of the engine in the engine generator, it must be used appropriately in an environment where ventilation is sufficient.

On the other hand, if an engine generator is used near (relatively near) a building, the indoor environment may be affected even in the outdoor use of the engine generator. As a countermeasure, it is considered that a sensor for detecting an exhaust gas is arranged indoors, and the engine generator is arranged to be communicable with the sensor. However, use of the engine generator in consideration of the limitations such as the indoor arrangement position of the sensor, the distance at which the engine generator can communicate with the sensor, and the like causes the degradation of usability.

SUMMARY OF THE INVENTION

The present invention can implement user's appropriate and simple use of an engine generator with a relatively simple arrangement.

One of the aspects of the present invention provides an engine generator, comprising an engine, a power generator configured to generate electric power based on motive power of the engine, a cooling fan configured to generate a cooling wind for cooling the engine, a control panel configured to accept an operation input by a user, a storage chamber configured to store a constituent part of the control panel, a sensor unit configured to detect a predetermined gas in the storage chamber, and a controller configured to stop the engine based on a detection result of the sensor unit, wherein the storage chamber stores the sensor unit and communicates with outer air such that a gas in the storage chamber can be suctioned by the cooling fan.

Further features of the present invention will become apparent from the following description of exemplary embodiments with reference to the attached drawings.

DESCRIPTION OF THE EMBODIMENTS

Figure 1:
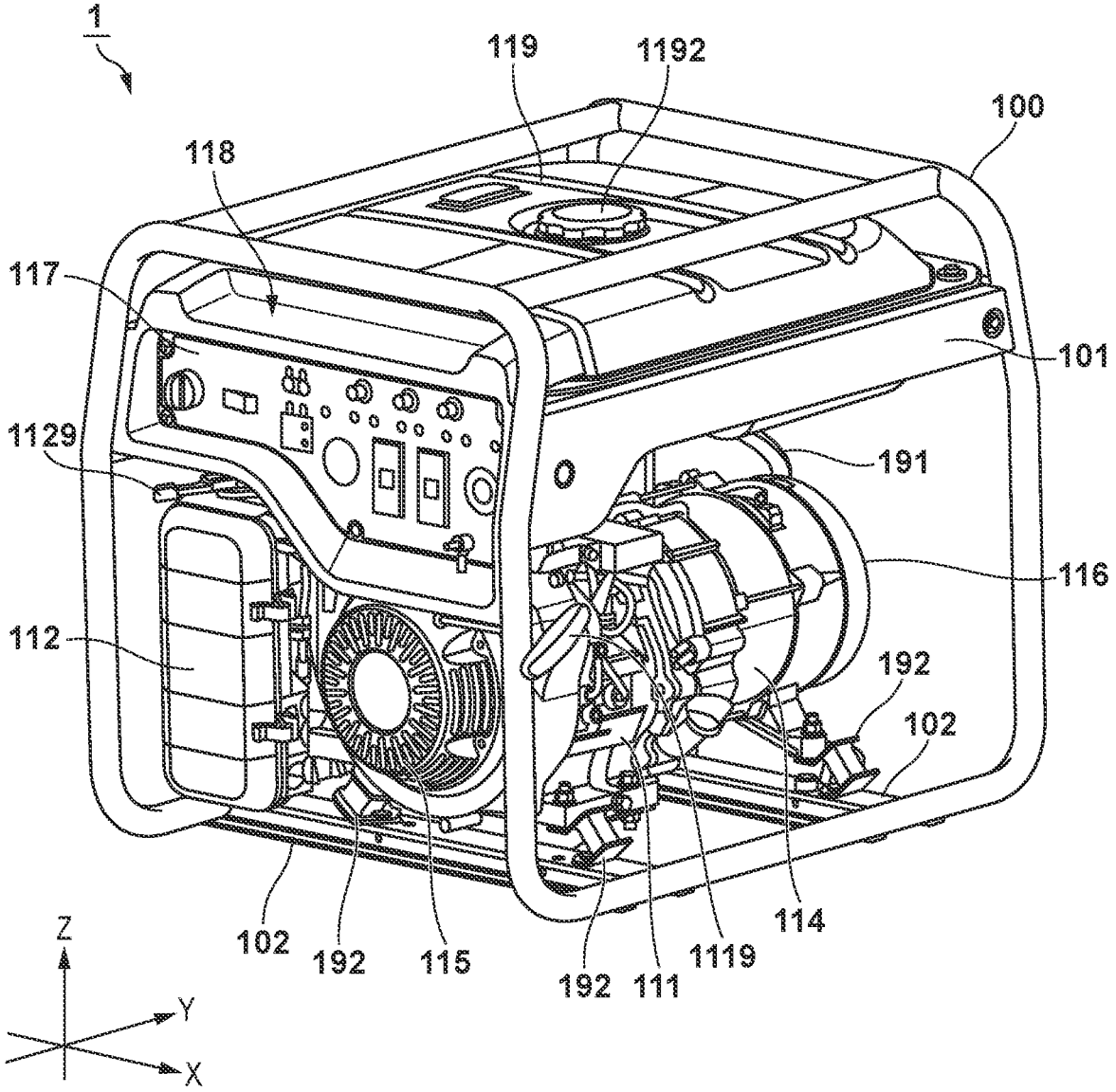
FIG. 1 is a perspective view of the overall arrangement of an engine generator from a given viewpoint.

Hereinafter, embodiments will be described in detail with reference to the attached drawings. Note, the following embodiments are not intended to limit the scope of the claimed invention, and limitation is not made an invention that requires a combination of all features described in the embodiments. Two or more of the multiple features described in the embodiments may be combined as appropriate. Furthermore, the same reference numerals are given to the same or similar configurations, and redundant description thereof is omitted.

Figure 2:
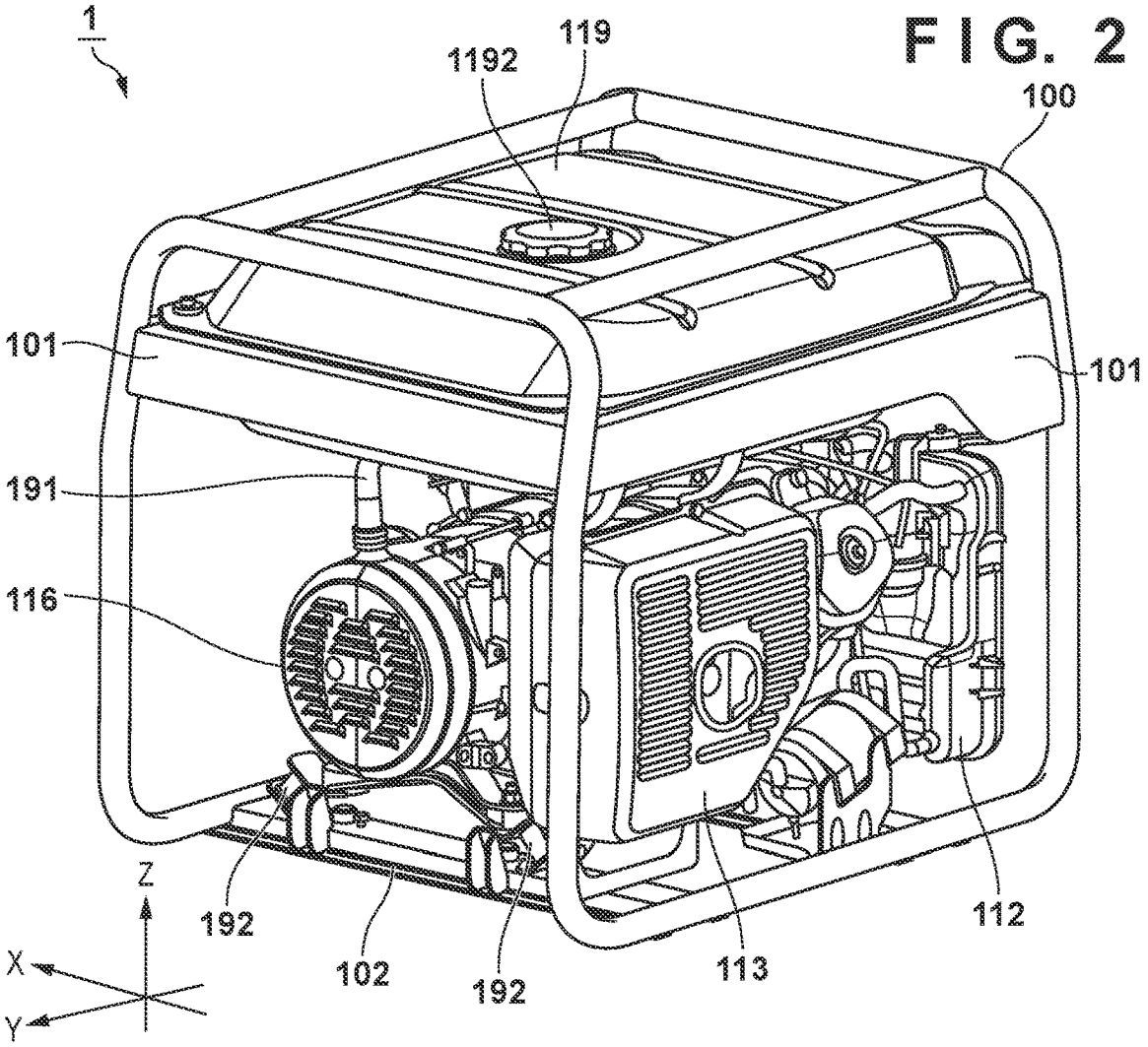
FIG. 2 is a perspective view of the overall arrangement of the engine generator from another viewpoint.

FIG. 1 is a perspective view of an engine generator 1 according to an embodiment. FIG. 2 is a perspective view of the engine generator 1 from the viewpoint different from that of FIG. 1. In order to facilitate understanding of the structure of the engine generator 1, X-, Y-, and Z-axes perpendicular to each other are shown in FIGS. 1 and 2. The X direction corresponds to the right-and-left direction or the width direction of the engine generator 1. The Y direction corresponds to the depth direction of the engine generator 1. The Z direction corresponds to the vertical direction or the height direction of the engine generator 1. In addition, in a state in which the engine generator 1 is placed, the X-Y plane corresponds to the horizontal direction, and the Z direction corresponds to the vertical direction.

In the engine generator 1, the −Y direction side, +Y direction side, −X direction side, and +X direction side are defined as the front side, rear side, left side, and right side, respectively. The −Z direction side and +Z direction side are defined as the lower (bottom) side and upper side, respectively. In the following description, the viewpoint in the +Y direction is called the front view, and the viewpoint in the −Z direction is called a top view (plan view).

The engine generator 1 includes a frame (frame-like member) 100 formed from a pipe made of a metal such as iron such that the pipe is formed into an almost cubic shape. On the rear side and the both the lateral sides, beams 101 are mounted in the frame 100. On the lower side, beams 102 are mounted in the frame 100. The constituent elements (to be described later) of the engine generator 1 are fixed in the frame 100 via the beams 101 and the beams 102.

In the lower portion, the engine generator 1 further includes an engine 111, an air cleaner 112, a muffler 113, and a power generator 114. The air cleaner 112 is arranged at a position on the intake side of the engine 111 (in this case, the position on the rear side and the lateral side with respect to the engine 111). The muffler 113 is arranged on the exhaust side of the engine 111 (in this case, the position on the rear side and the lateral side with respect to the engine 111). Although details will be described later, the power generator 114 can generate electric power based on the motive power (rotation) of the engine 111. Note that known devices can be employed as the engine 111, the air cleaner 112, the muffler 113, and the power generator 114.

The engine 111 and the power generator 114 are connected in parallel with each other along the Y direction and are fixed to the beams 102 via predetermined fixing members 192. In this embodiment, the engine 111 is located on the front side, while the power generator 114 is located on the rear side. The power generator 114 can receive the motive power from the engine 111 and generate an electric power based on the motive power. The air cleaner 112 and the muffler 113 are arranged such that they overlap each other at a position shifted laterally from the power generator 114 and partially overlap the engine 111. A choke lever 1129 for adjusting an amount of air supplied to the engine 111 is arranged on the air cleaner 112.

In the lower portion, the engine generator 1 further includes a front cover 115 and a rear cover 116. Although details will be described later, the front cover 115 is arranged on the front side with respect to the engine 111. The rear cover 116 is arranged on the rear side with respect to the power generator 114. A recoil starter 1119 is arranged to be pulled in the engine 111 on the side of the front cover 115. The user can assist the operation of the engine 111 by pulling the recoil starter 1119.

In the upper portion on the front side, the engine generator 1 further includes a control panel 117 and a storage chamber 118. The control panel 117 is arranged to accept an operation input by the user. For example, a start switch is arranged on the front side of the control panel 117. The user operates the start switch to allow the operation of the engine 111. In addition, for example, at least one output terminal (electrical outlet) is arranged on the front side of the control panel 117. When the user inserts the plug of a desired electric device into the corresponding output terminal, the electric power generated by the power generator 114 can be used. In addition, for example, a frequency change switch is arranged on the front side of the control panel 117. When the user operates the frequency change switch, the frequency of the electric power output from the above output terminal can be changed. In addition, for example, one or more indicators are arranged on the front side of the control panel 117. When the user observes the indicators, he/she can recognize, for example, that the output load exceeds the reference value.

The storage chamber 118 partitions a predetermined space together with the control panel 117 to store constituent parts of the control panel 117. A plurality of electrical parts corresponding to the start switch, the output terminals, the frequency change switch, and the indicators are arranged on the rear side of the control panel 117. The storage chamber 118 stores the plurality of electrical parts (for example, semiconductor packages) and the wires and cables electrically connected to the plurality of electrical parts.

In the upper portion on the rear side, the engine generator 1 further includes a fuel tank 119. The fuel tank 119 stores the fuel of the engine 111. The user can remove a cap 1192 of the fuel tank 119 and supply the fuel to the fuel tank 119. The storage chamber 118 and the fuel tank 119 are arranged adjacent to each other in the Y direction. The storage chamber 118 and the fuel tank 119 are fixed to the beams 101 by fastening using, for example, screws.

Figure 3:
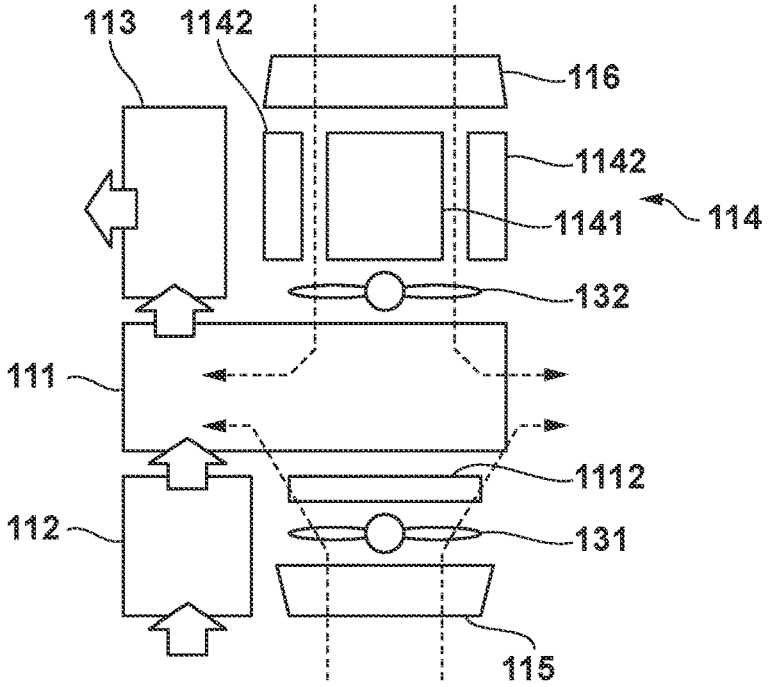
FIG. 3 is a block diagram for explaining part of the arrangement of the engine generator.

FIG. 3 is a block diagram for explaining the system arrangement of the engine generator 1. Hollow arrows in FIG. 3 indicate the intake path to the engine 111 via the air cleaner 112 and the exhaust path from the engine 111 via the muffler 113.

The engine generator 1 further includes a flywheel 1112 serving as a constituent element of the engine 111. The flywheel 1112 is arranged to be rotatable upon reception of the motive power of the engine 111 and stabilizes the rotation of the engine 111.

The power generator 114 includes a rotor 1141 and a stator 1142. The rotor 1141 is arranged to be rotatable upon reception of the motive power of the engine 111. A permanent magnet is arranged in the rotor 1141. The stator 1142 is arranged such that a plurality of coils are wound around the stator core. With this arrangement, the power generator 114 can send out, from the cable 191 (see FIGS. 1 and 2), an induction current generated by the stator 1142 upon rotation of the rotor 1141.

As shown in FIG. 3, the engine generator 1 further includes cooling fans 131 and 132. Each of the cooling fans 131 and 132 can be rotated upon reception of the motive power of the engine 111 and suctions the outer air (that is, the ambient air of the engine generator 1) as indicated by the broken arrows in FIG. 3.

The cooling fan 131 is arranged between the engine 111 (the flywheel 1112) and the front cover 115. As can also be obvious from FIG. 1, the front cover 115 is a cup-like or conical front cover. A plurality of slit holes are formed in the button portion (a portion facing the front side) and the side surface portions of the front cover 115. Based on the motive power of the engine 111, the cooling fan 131 suctions the outer air from the plurality of slit holes of the front cover 115 and supplies the outer air to the engine 111 as the cooling wind.

The cooling fan 132 is arranged between the engine 111 and the power generator 114. As can also be obvious from FIG. 2, the rear cover 116 is a cylindrical fan cover. A plurality of slit holes are formed in the bottom portion (a portion facing the rear side) of the rear cover 116. Based on the motive power of the engine 111, the cooling fan 132 suctions the outer air from the plurality of slit holes of the rear cover 116 and supplies the outer air to the engine 111 after the outer air passes through the power generator 114 as the cooling wind.

That is, the engine 111 is arranged between the cooling fans 131 and 132 and receives the cooling winds from both the front side and the rear side. Accordingly, this structure is advantageous for cooling the engine 111. In addition, the cooling fan 132 is arranged between the engine 111 and the power generator 114. The cooling fan 132 suctions the outer air as the cooling wind. The cooling wind passes through the power generator 114 and is supplied to the engine 111. Accordingly, this structure can be said to be advantageous for cooling the power generator 114. Note that the cooling winds blown to the engine 111 from the front and rear sides by the cooling fans 131 and 132 are then exhausted laterally.

In summary, the engine 111 and the power generator 114 are arranged in parallel to each other in the Y direction, and in the lateral direction thereof, the air cleaner 112 and the muffler 113 are arranged to overlap each other in the Y direction in the front view. This structure is advantageous in the compactness of the structure of the engine generator 1. In addition, the engine 111 can be cooled by the cooling winds of both the cooling fans 131 and 132. In addition, the cooling wind from the cooling fan 132 passes through the power generator 114. According to this structure, in addition, cooling of the engine 111 and the power generator 114 can be appropriately implemented.

The cooling fan 131 and the air cleaner 112 are arranged adjacent to each other in the X direction below the control panel 117. In addition, as can be obvious from FIG. 1, the vertical width of the air cleaner 112 is larger than that of the cooling fan 131 (and the front cover 115). Along with this, the control panel 117 and the storage chamber 118 have a recessed shape above the air cleaner 112. This structure is advantageous in the further compactness of the structure of the engine generator 1.

The user can install this engine generator 1 at a desired position by grasping, for example, the frame 100. The user can use the engine generator 1 as a power source for driving a desired electric device.

Figure 4:
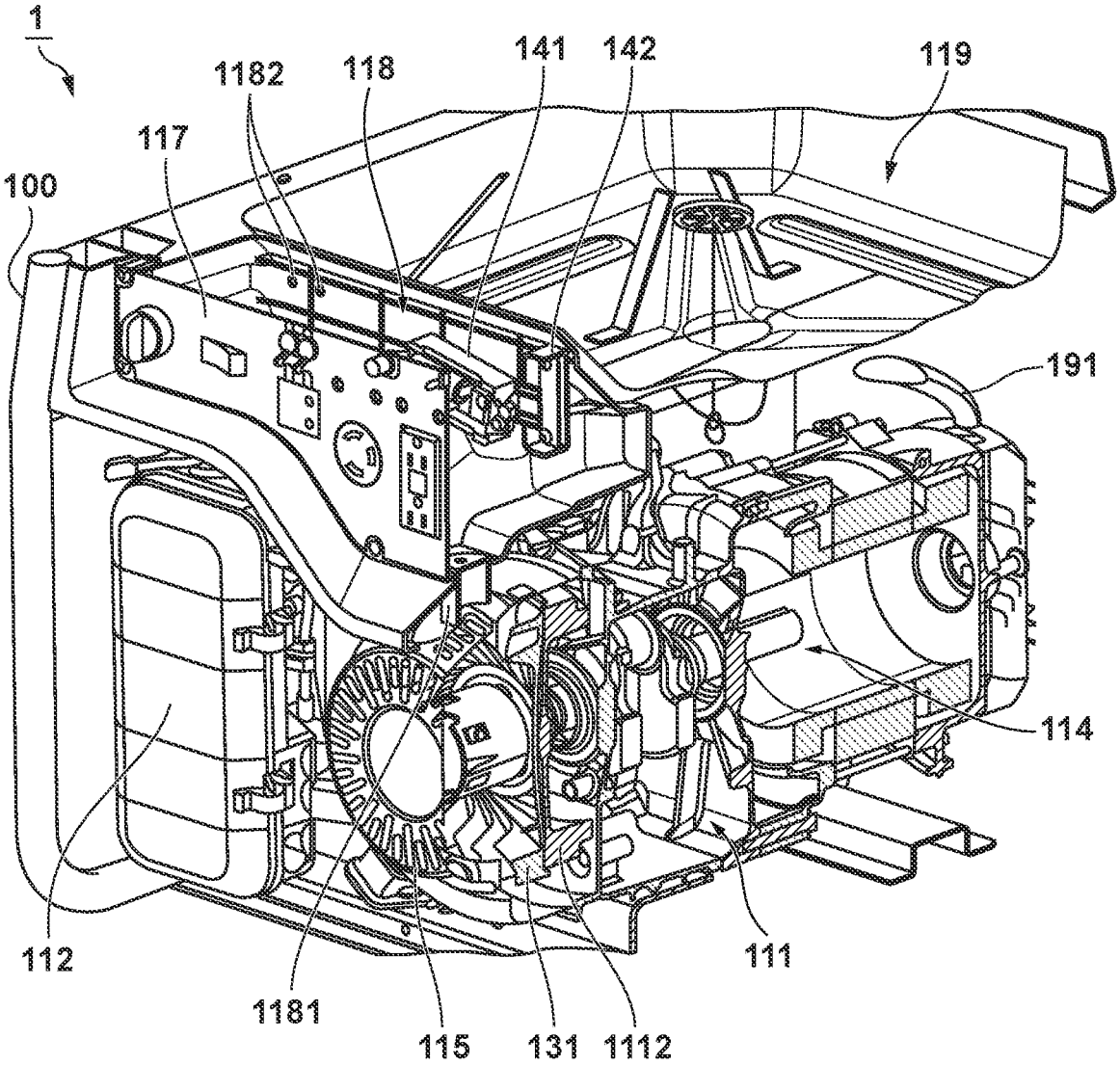
FIG. 4 is a sectional perspective view for explaining the arrangement of the engine generator.

FIG. 4 is a sectional perspective view of the engine generator 1 to show the internal structure of the storage chamber 118. Note that FIG. 4 shows the internal structure of the engine 111 and the power generator 114 additionally.

The engine generator 1 further includes a sensor unit 141 and a controller 142. In this embodiment, both the sensor unit 141 and the controller 142 are arranged in the storage chamber 118. That is, the storage chamber 118 further stores the sensor unit 141 and the controller 142.

The sensor unit 141 is arranged so that a predetermined gas in the storage chamber 118 can be detected. In this case, the sensor unit 141 detects carbon monoxide gas (CO gas) as a typical example of the exhaust gas upon driving of the engine 111.

The controller 142 is electrically connected to (the electronic parts of) the rear side of the control panel 117 via wires and cables (not shown). Electric power generated by the power generator 114 is sent to the controller 142 via a cable 191. The controller 142 includes, for example, cyclone converter which can covert the electric power from the power generator 114 into a predetermined form and output the predetermined form from the output terminal of the control panel 117.

In addition, the controller 142 is electrically connected to the sensor unit 141 via wires and cables (not shown). For example, if the sensor unit 141 detects CO gas, the controller 142 receives the detection result from the sensor unit 141 and stops the engine 111 set in the operating state.

Figure 5:
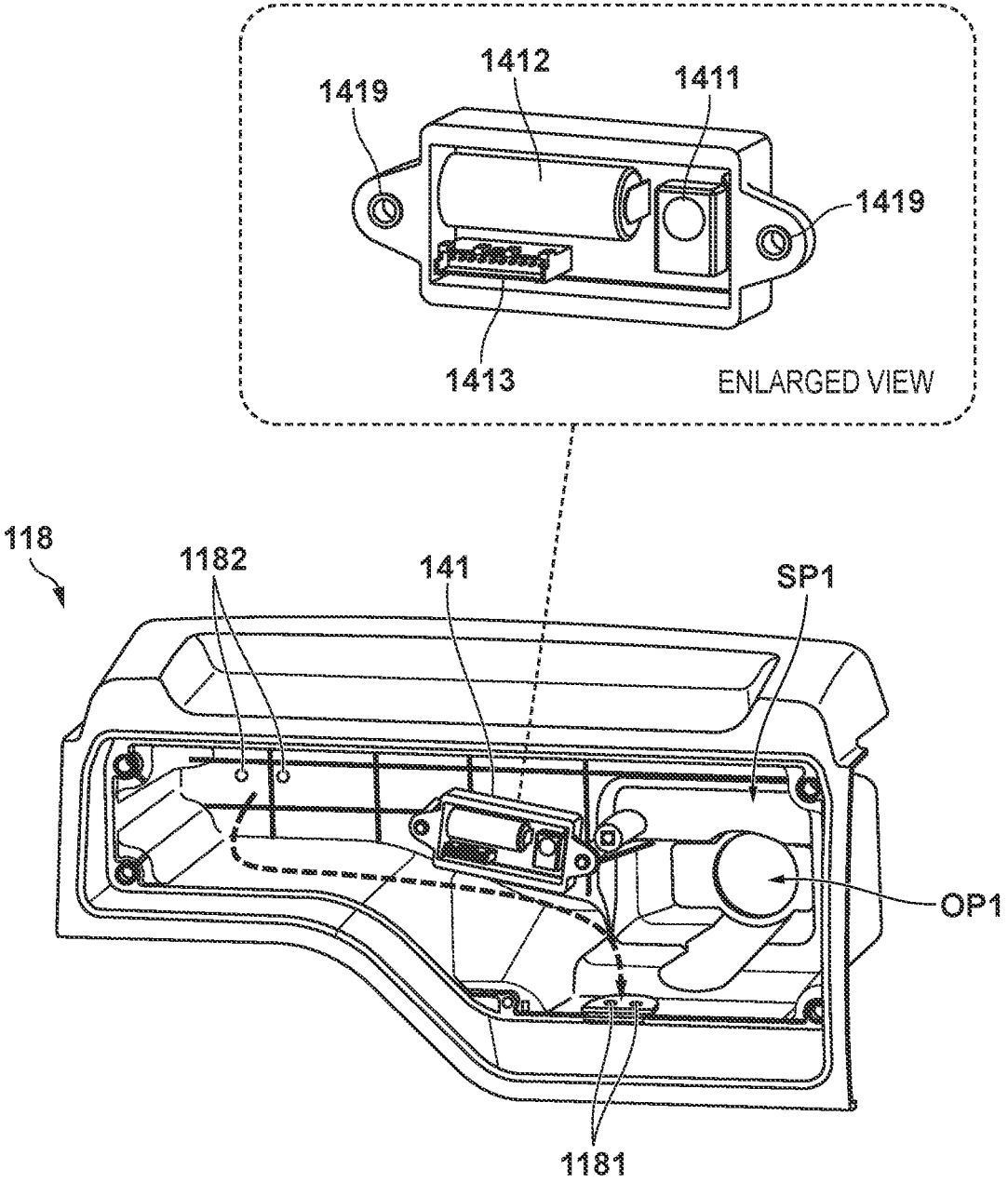
FIG. 5 shows perspective views for explaining the internal structure of a storage chamber.

FIG. 5 is a perspective view for explaining the internal structure of the storage chamber 118. FIG. 5 does not show the control panel 117, the electrical parts on the rear side of the control panel 117, and wires and cables. As described above, the sensor unit 141 for detecting the CO gas in the storage chamber 118 is arranged in the storage chamber 118. An opening portion OP1 is formed in the wall portion of the storage chamber 118. The controller 142 is arranged in a space SP1 around the opening portion OP1 and electrically connected to the cable 191 inserted through the opening portion OP1.

As shown in the enlarged view of FIG. 5, the sensor unit 141 includes, in a bracket attached to the storage chamber 118, a sensor main body 1411 forming a detection surface, a battery 1412, and a connector 1413. In this embodiment, the sensor main body 1411 is formed from an electrochemical gas sensor operated based on the electric power of the battery 1412. In another embodiment, various kinds of methods such as a contact combustion method and an infrared method can be employed. The sensor unit 141 is electrically connected to the controller 142 via a cable (not shown) inserted into the connector 1413. If a gas passing through the detection surface of the sensor main body 1411 contains the CO gas exceeding the reference value, the sensor unit 141 outputs a detection signal indicating the detection of the CO gas to the controller 142.

The sensor unit 141 is attached to the wall portion of the storage chamber 118 by, for example, fastening in an attaching portion 1419 formed at the end portion of the bracket. In this case, the sensor unit 141 is fixed such that the detection surface is set in a posture to face from the lower direction to one of the lateral directions. Accordingly, this detection surface can prevent the attachment of a foreign substance (for example, sand or dust) having a relatively small size and existing in the storage chamber 118. Note that the detection surface may face upward. In this case, a wall for preventing a dropping substance is arranged above the detection surface so as to prevent the foreign substance from dropping and attaching to the detection surface.

Opening portions 1181 and opening portions 1182 are further formed in the wall portions of the storage chamber 118. The opening portions 1181 and 1182 are ventilation openings in the storage chamber 118. The number of opening portions 1181 or 1182 can be at least one. In this embodiment, the opening portions 1181 are openings for exhausting the gas in the storage chamber 118. The opening portions 1182 are openings for flowing the gas into the storage chamber 118. The sensor unit 141 is arranged between the opening portions 1181 and 1182.

As can be obvious from FIGS. 4 and 5, the opening portions 1181 are arranged at portions near the cooling fan 131 out of the wall portion of the storage chamber 118. According to this structure, the gas in the storage chamber 118 can appropriately be exhausted by a negative pressure upon driving of the cooling fan 131.

Similarly, as can be obvious from FIGS. 4 and 5, the opening portions 1182 are formed at portions near the fuel tank 119 out of the wall portion of the storage chamber 118. According to this structure, along with the exhaust (the exhaust of the gas from the opening portions 1181) of the gas, it is possible to introduce the outer air from the opening portions 1182 to the storage chamber 118. In addition, in this structure, the peripheral portion of the opening portions 1182 out of the wall portion of the storage chamber 118 opposes the fuel tank 119. For this reason, mixing of the unexpected foreign substance from the opening portions 1182 to the storage chamber 118 can also be prevented.

According to this structure, the storage chamber 118 communicates with the outer air such that the internal gas can be suctioned by the cooling fan 131. Accordingly, since the gas in the storage chamber 118 does not stay inside, the sensor unit 141 in the storage chamber 118 can detect the CO gas, and the controller 142 can determine whether the use environment of the engine generator 1 is appropriate.

As described above (refer to FIG. 1), the plurality of slit holes are formed in the bottom portion (the portion on the front side) and the side surface portions of the cup-like or conical front cover 115. In this structure, the opening portions 1181 are located immediately above the side surface portions of the front cover 115. Accordingly, the gas in the storage chamber 118 can be easily exhausted. That is, the ventilation efficiency in the storage chamber 118 can be improved. Therefore, the above detection by the sensor unit 141 can be more appropriately implemented, and the above determination for the use environment of the engine generator 1 can be more appropriately performed.

Figure 6:
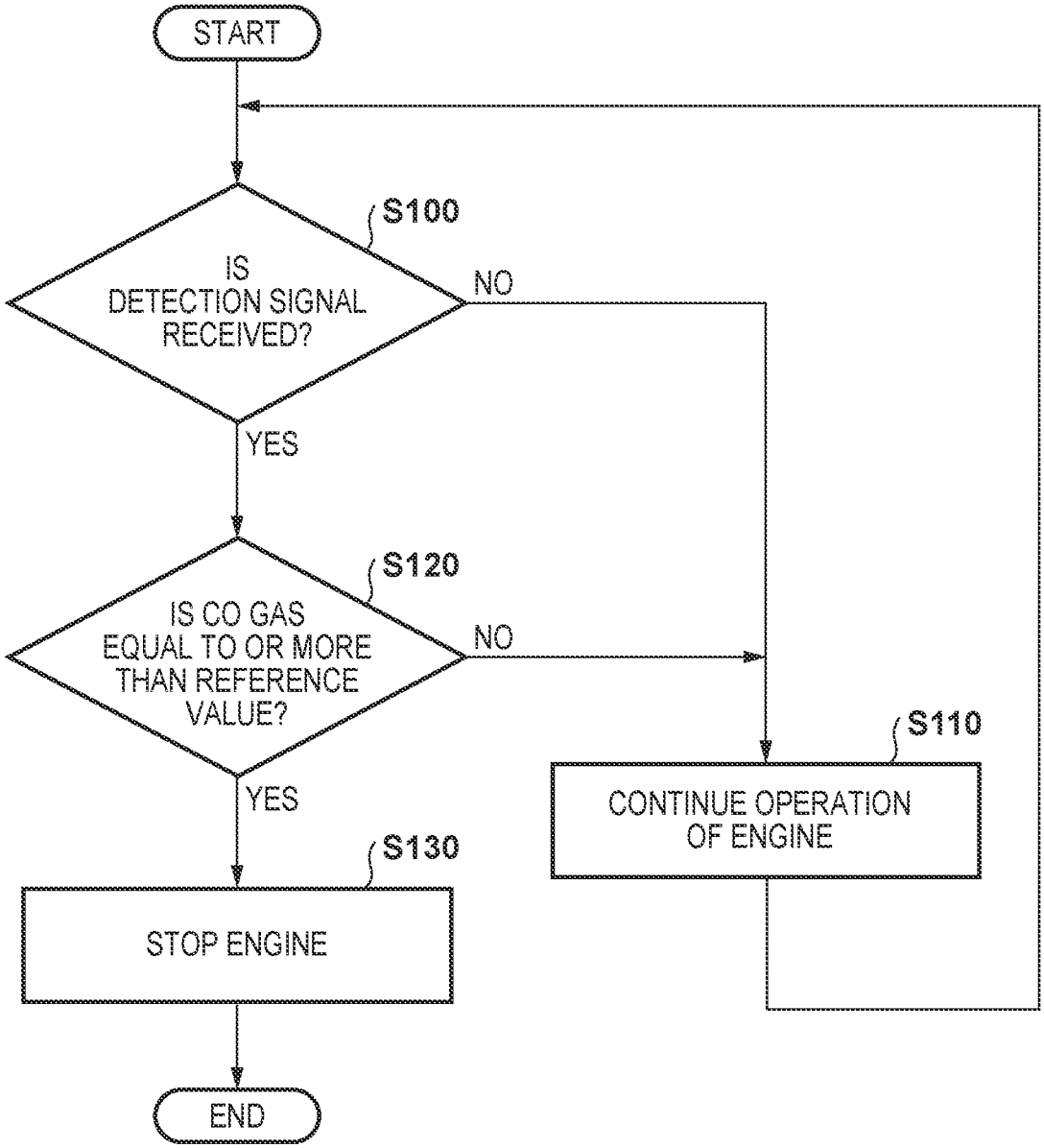
FIG. 6 is a flowchart for explaining an example of a control method of a controller.

FIG. 6 is a flowchart showing a method for controlling the engine generator 1. This control is started in accordance with the user's operation input to the control panel 117 and operation of the engine 111. This control is executed mainly by the controller 142, and its outline is given such that the engine 111 is stopped when the sensor 141 detects that the concentration of the CO gas in the storage chamber 118 is equal to or more than the reference value.

Note that in this embodiment, the controller 142 further includes an ASIC (Application Specific Integrated Circuit) and executes the above control using the ASIC. As another embodiment, a CPU (Central Processing Unit) and a memory may be further included, and this control may be executed using the CPU and the memory. That is, this control can be implemented using any one of hardware and software.

First, in step S100 (step S100 will be simply referred to as "S100", and this will also applies to other steps to be described later), the controller 142 determines whether a detection signal from the sensor 141 is received. The detection signal indicates the detection of the CO gas in the storage chamber 118, and its signal value indicates the concentration of the CO gas. If no detection signal is received (or the signal value is 0), the process advances to S110. If the detection signal is received, the process advances to S120.

In S110, it is determined that the operation of the engine 111 continues, and the process returns to S100.

It is determined in S120 whether the concentration of the CO gas is equal to or more than the reference value. This determination is performed by comparing the signal value of the detection signal with the reference value. For example, if the signal value of the detection signal is equal to or more than the reference value, the process advances to S130 because the concentration of the CO gas is equal to or more than the reference value; otherwise, the process advances to S110. Note that the reference value used in the above comparison may be expressed as an allowable value, a threshold value, or the like.

Since it is determined that the concentration of the CO gas in the storage chamber 118 is equal to or more than the reference value, it is determined in S130 that the operation of the engine 111 will be stopped. In accordance with this, the controller 142 outputs a stop signal for stopping the engine 111.

According to this control method, if the engine generator 1 is used under an environment in which ventilation is not sufficient, the engine 111 can appropriately be stopped. For the sake of descriptive simplicity, the contents of this control are described in S100 to S130. However, some of the steps may be performed almost simultaneously, or any other steps may be added to this control. For example, S100 and S120 can be executed almost simultaneously by the controller 142.

According to the engine generator 1 of this embodiment, the storage chamber 118 stores the sensor unit 141 and communicates with the outer air so that the gas in the storage chamber 118 can be suctioned by the cooling fan 131. For this reason, when the engine generator 1 is used under an environment in which ventilation is not sufficient, the engine 111 can appropriately be stopped. This can be implemented by arranging the sensor unit 141 in the storage chamber 118 and can be implemented using a relatively simple arrangement. Therefore, according to this embodiment, the user can install the engine generator 1 at an arbitrary position and use it, so that the engine generator 1 can appropriately and easily be used.

As has been described above, for the sake of facilitating understanding, each element is illustrated using a name associated with its function. However, each element is not limited to an element having the contents described in each embodiment as the main function, but may include an element having the contents described in each embodiment as an auxiliary function.

Several features of each of the above embodiments will be summarized below.

The first mode is related to an engine generator (for example, 1). The engine generator is characterized by comprising an engine (for example, 111), a power generator (for example, 114) configured to generate electric power based on motive power of the engine, a cooling fan (for example, 131) configured to generate a cooling wind for cooling the engine, a control panel (for example, 117) configured to accept an operation input by a user, a storage chamber (for example, 118) configured to store a constituent part of the control panel, a sensor unit (for example, 141) configured to detect a predetermined gas in the storage chamber, and a controller (for example, 142) configured to stop the engine based on a detection result of the sensor unit, wherein the storage chamber stores the sensor unit and communicates with outer air such that a gas in the storage chamber can be suctioned by the cooling fan. According to the first mode, if the engine generator is used under an environment in which ventilation is not sufficient, the engine can appropriately be stopped. In addition, this control can be implemented using a relatively simple arrangement. Therefore, according to the first mode, the user can appropriately and easily use the engine generator.

As the second mode, the engine generator is characterized in that the controller is arranged in the storage chamber. According to the second mode, in the storage chamber, the controller can appropriately and electrically be connected to the constituent elements of the control panel and the sensor unit. Wires and cables for implementing the above electrical connections can also be stored in the storage chamber. Therefore, this arrangement is advantageous in simplifying the structure of the engine generator.

As the third mode, the engine generator is characterized in that the storage chamber includes a first opening portion (for example, 1181) configured to exhaust the gas in the storage chamber and a second opening portion (for example, 1182) configured to flow the gas into the storage chamber. According to the third mode, since the gas does not stay in the storage chamber, the use environment of the engine generator can appropriately be determined based on the detection result of the sensor unit.

As the fourth mode, the engine generator is characterized in that the first opening portion is formed at a portion near the cooling fan out of a wall portion of the storage chamber. According to the fourth mode, the gas in the storage chamber can appropriately be exhausted by a negative pressure upon driving the cooling fan.

As the fifth mode, the engine generator is characterized by further comprising a fuel tank (for example, 119) configured to store fuel of the engine, wherein the storage chamber and the fuel tank are arranged adjacent to each other, and the second opening portion is arranged at a portion near the fuel tank out of a wall portion of the storage chamber. According to the fifth mode, the outer air can be introduced into the storage chamber, and mixing of an unexpected foreign substance into the storage chamber can be prevented.

As the sixth mode, the engine generator is characterized by further comprising an air cleaner (for example, 112) arranged on the engine on a suction side, wherein the cooling fan and the air cleaner are arranged adjacent to each other below the control panel in a horizontal direction (for example, the X direction). According to the sixth mode, the arrangement is advantageous in compactness of the structure of the engine generator.

As the seventh mode, the engine generator is characterized by further comprising a muffler (for example, 113) arranged on the engine on an exhaust side, wherein the air cleaner and the muffler are arranged to overlap each other in a planar view (for example, a viewpoint in the Y direction).

According to the seventh mode, this arrangement is advantageous in compactness of the structure of the engine generator.

As the eighth mode, the engine generator is characterized in that a width of the air cleaner in a vertical direction is larger than a width of the cooling fan in the vertical direction, and the control panel and the storage chamber have a recessed shape above the air cleaner. According to the eighth mode, this arrangement is advantageous in compactness of the structure of the engine generator.

As the ninth mode, the engine generator is characterized in that the sensor unit is arranged in the storage chamber such that a detection surface (for example, 1411) of the sensor unit is fixed in a posture in which the detection surface faces one of a lower direction and a lateral direction. According to the ninth mode, a foreign substance (for example, sand or dust) having a relatively small size can be prevented from attaching to the detection surface of the sensor unit.

As the 10th mode, the engine generator is characterized by further comprising a second cooling fan (for example, 132) configured to generate a cooling wind for cooling the engine while the cooling fan is used as a first cooling fan (for example, 131), wherein the engine is located between the first cooling fan and the second cooling fan. According to the 10th mode, the arrangement is advantageous in cooling the engine.

As the 11th mode, the engine generator is characterized in that the second cooling fan is located between the engine and the power generator, and the second cooling fan suctions outer air as the cooling wind, and sends the cooling wind to the engine via the power generator. According to the 11th mode, the arrangement is advantageous in also cooling the power generator.

As the 12th mode, the engine generator is characterized in that the sensor unit is arranged to allow detection of carbon oxide gas (CO gas). A typical example of the exhaust gas generated upon driving the engine is CO gas. According to the 12th mode, the user can appropriately and easily use the engine generator.

The present invention is not limited to the embodiments described above, and various changes and modifications can be made within the spirit and scope of the invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An engine generator comprising:

an engine;

a power generator configured to generate electric power based on motive power of the engine;

a cooling fan configured to generate a cooling wind for cooling the engine;

a control panel configured to accept an operation input by a user;

a sensor unit configured to detect a predetermined gas;

a controller configured to stop the engine based on a detection result of the sensor unit; and a cubic shaped frame with one or more beams, on which the engine, the power generator, the cooling fan and the control panel are fixed, wherein a storage chamber is formed by the control panel attached to the frame, a constituent part of the control panel is provided on a face of the control panel, the face being an inner face for the storage chamber, and the storage chamber stores the sensor unit and communicates with outer air such that a gas in the storage chamber can be suctioned by the cooling fan.

2. The engine generator according to claim 1, wherein the controller is arranged in the storage chamber.

3. The engine generator according to claim 1, wherein the storage chamber includes:

a first opening portion configured to exhaust the gas in the storage chamber; and a second opening portion configured to flow the gas into the storage chamber.

4. The engine generator according to claim 3, wherein the first opening portion is formed at a portion near the cooling fan out of a wall portion of the storage chamber.

5. The engine generator according to claim 3, further comprising a fuel tank configured to store fuel of the engine, wherein the storage chamber and the fuel tank are arranged adjacent to each other, and the second opening portion is arranged at a portion near the fuel tank out of a wall portion of the storage chamber.

6. The engine generator according to claim 1, further comprising an air cleaner arranged on the engine on a suction side, wherein the cooling fan and the air cleaner are arranged adjacent to each other below the control panel in a horizontal direction.

7. The engine generator according to claim 6, further comprising a muffler arranged on the engine on an exhaust side, wherein the air cleaner and the muffler are arranged to overlap each other in a planar view.

8. The engine generator according to claim 6, wherein a width of the air cleaner in a vertical direction is larger than a width of the cooling fan in the vertical direction, and the control panel and the storage chamber have a recessed shape above the air cleaner.

9. The engine generator according to claim 1, wherein the sensor unit is arranged in the storage chamber such that a detection surface of the sensor unit is fixed in a posture in which the detection surface faces one of a lower direction and a lateral direction.

10. The engine generator according to claim 1, further comprising a second cooling fan configured to generate a cooling wind for cooling the engine while the cooling fan is used as a first cooling fan, wherein the engine is located between the first cooling fan and the second cooling fan.

11. The engine generator according to claim 10, wherein the second cooling fan is located between the engine and the power generator, and the second cooling fan suctions outer air as the cooling wind, and sends the cooling wind to the engine via the power generator.

12. The engine generator according to claim 1, wherein the sensor unit is arranged to allow detection of carbon oxide gas.

* * * * *